United States Patent [19]

Cagnoni

[11] 4,336,787

[45] Jun. 29, 1982

[54] PRE-COMPRESSED AIR WEAPON

[76] Inventor: Giacomo Cagnoni, Via Cassolnuovo 7, Abbiategrasso (Milan), Italy

[21] Appl. No.: 170,451

[22] Filed: Jul. 21, 1980

[51] Int. Cl.[3] ..... F41B 11/00

[52] U.S. Cl. ..... 124/69; 124/76

[58] Field of Search ..... 124/66, 67, 68, 69, 124/70, 73, 76

[56] References Cited

U.S. PATENT DOCUMENTS

| | | | |
|---|---|---|---|
| 156,890 | 11/1874 | Quackenbush | 124/67 |
| 1,073,455 | 9/1913 | Wissler | 124/70 |
| 1,481,526 | 1/1924 | Paul | 124/69 |
| 1,897,226 | 2/1933 | Anson | 124/67 |
| 2,713,859 | 7/1955 | Bradfield | 124/67 X |
| 3,233,601 | 2/1966 | Walther | 124/69 |
| 4,038,961 | 8/1977 | Olofsson | 124/69 |

FOREIGN PATENT DOCUMENTS

| | | | |
|---|---|---|---|
| 711542 | 7/1954 | United Kingdom | 124/69 |

*Primary Examiner*—Richard T. Stouffer

*Attorney, Agent, or Firm*—McGlew and Tuttle

[57] ABSTRACT

The present invention provides an improved weapon such as a rifle or a pistol including a system of levers that are displaceable laterally towards the front part of the weapon for operating structure for the intake and compression of the compression air used in the weapon. The barrel for the weapon is axially displaceable on a slide by utilizing the displacement of the piston for the intake and compression of air. Sealing structure is provided on the breach of the barrel in the form of a tablet-shaped packing that also insures the correct insertion of the ammunition.

17 Claims, 9 Drawing Figures

PRE-COMPRESSED AIR WEAPON

The present invention concerns a weapon of the type using pre-compressed air, said weapon being made both in the form of a rifle and of a pistol.

Various types of weapons using pre-compressed air are already known which, however, in practice do not have that functional ability handling and capacity which a user may require, nor do they make it possible to achieve high velocities in the firing of bullets or pellets, in view of deficiencies in the means for compressing the air and in the means for sealing the breach of the barrel when closing it for the shot.

It is therefore the object of the present invention to provide a weapon, whether it be a rifle or a pistol, which permits more proficient use of the pre-compressed air for increasing the force and, hence, the velocity of propulsion of the bullets or pellets, so as to make the weapon more efficient and competitive with respect to weapons of known type.

Another object of the present invention is to provide improved means for the intake and compression of the propelling air, said means being smoothly operable with minimum force by means of a system of levers displaceable laterally and towards the front part of the weapon.

A further object is to provide a weapon using pre-compressed air and having a barrel axially displaceable on a slide for the opening and closing thereof by utilising the displacements of the piston for the intake and compression of air.

Yet another object of the present invention is to provide sealing means on the breach of the barrel in the form of a tablet-shaped facing or packing designed also to ensure the correct insertion of the bullet or pellet into the barrel and thus to obtain pre-alignment thereof.

Yet another object of the present invention is to provide the pre-compressed air operated weapon with an assembly or detent mechanism of simple design and reliable efficiency arranged so that it can be advantageously demounted as a unit from the weapon for the maintenance of said weapon.

Not the least object of the present invention is to improve the components of the weapon in general and the arrangement thereof so as to achieve ballistic and yield results never achieved hitherto but without their having a negative influence on the economical use of the weapon.

According to the present invention there is provided a weapon such as a pistol or rifle, using pre-compressed air and comprising a frame, a barrel mounted on said frame and having a breach closable against a stationary shoulder and a displaceable piston for the intake of air into a cylindrical chamber and compressing it in a compression chamber closable and openable by means of a mushroom-shaped valve, said compression chamber communicating with the bore of the barrel through a discharge bore opening into said stationary shoulder, the opening and closing of said valve being controlled by a spring and a release mechanism or assembly actuated by a trigger, said mechanism or assembly being activated by means of a mounting slide connected to said barrel, in which the barrel is guided on the frame to displace itself axially from a closing position against the stationary shoulder to an opening position and vice versa, said piston is displaceable in a cylindrical chamber with its axis parallel to said barrel and formed in a body secured to said frame, and said barrel and said piston are jointly displaceable over at least a part of the intake and compression movements of the piston itself, to the final part of the intake movement of the piston, a forward displacement of the barrel being for its opening and for the activation of the release mechanism by means of the mounting lever, whilst the final part of the compression movement of said piston corresponds to the displacement for closing and locking the barrel against the shoulder.

The present invention will be further illustrated by way of example, with reference to the accompanying drawings, in which.

Figure 1:
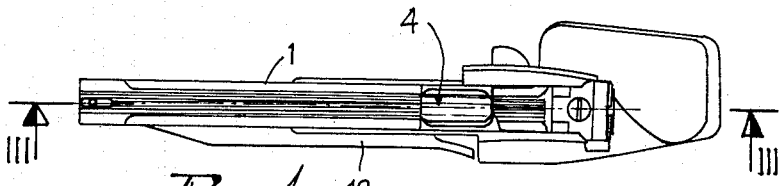
FIGS. 1 and 2 are two schematic top views of a weapon ready for use and with operating levers disposed in the loading position.

In the drawings the frame 1 of the weapon supports the barrel 2 which is axially displaced in one direction to project forwardly at the moment of opening the barrel for the insertion of a bullet or pellet 3 through an opening 4 formed in said frame, and in the opposite direction for locking at the rear with the associated breach 2' against a closure shoulder 5.

Secured to the frame 1, below the barrel, is a body 6 in which a cylindrical chamber 7 is formed for receiving an intake and compression piston 8 axially displaceable in a direction parallel to the barrel 2. The cylindrical chamber 7 communicates through a hole in the bottom 9 with a chamber 10 for the compression of the propelling air from which chamber there extends a discharge passage 11 for transmitting air towards the bore in the barrel 2, said bore opening into the shoulder 5 for the closing of the breach of the barrel. Between the compression chamber 10 and the passage 11 there is provided a valve seat 12 with a fitting 12' with which there is associated a mushroom-shaped valve 13 provided for the closing and opening of said chamber 10 for retaining or discharging, as desired, the air compressed therein. On one side the valve 13 is biased by an axial spring 14 for keeping the valve located in the closing position on the associated seat 12 with fitting 12'.

On the opposite side, the valve 13 has a stem 15 biased by a thrust lever 16 pivoted at 16' and intended to displace the valve away from the associated seat in opposition to the spring 14 in order to obtain the opening of the compression chamber and the discharge of compressed air towards the barrel 2 through the passage 11. The thrust lever 16 is controlled by an assembly or release mechanism which will be described hereinafter and which is joined to the trigger 17 of the weapon.

For the displacement of the piston 8 in the associated cylindrical chamber 7 it is proposed that at the front end of the body 6 there should be pivoted, by means of a journal 18, an operating lever 19 on which there is pivoted, by means of a journal 20, a tie rod or pin 21, the opposite end of which is pivoted by a journal 22 on said piston.

Figure 2:
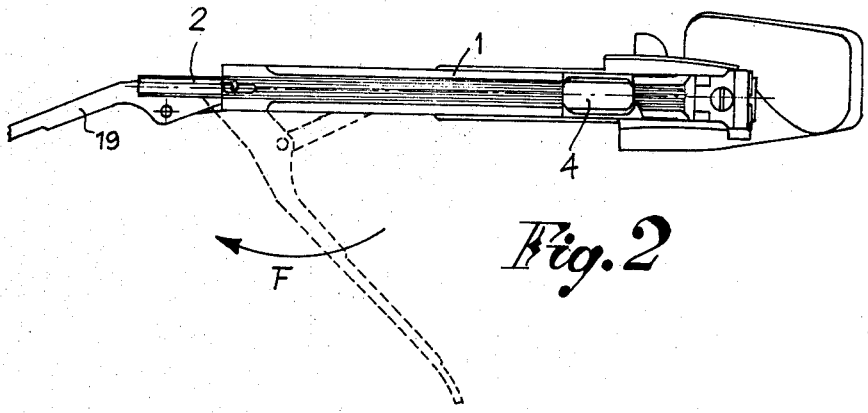

Substantially, the operating lever 19 is angularly displaceable and forwardly (arrow F in FIG. 2) about the associated journal 18, from a closed position on one side (right or left) of the weapon to a position almost in alignment with the piston 8, as shown in FIGS. 1 and 2 of the drawings, and vice versa. With said displacement of the lever 19 there corresponds by means of the rod or pin 21, axial displacements of the piston 8, firstly for the intake of air into the cylinder 7 and then for the compression of the air, through the bottom bore 9, in the compression chamber 10. It should be noted that the intake of air into the cylinder is effected by way of the seat 12 of the valve 13 in a phase in which it is open; hence, before the conclusion of the intake of air into the chamber 10, the valve 13 is closed by the associated spring 14 as soon as the action of the thrust lever 16 on the stem 15 of said valve has ceased.

In the weapon which has now been described we propose that, with the displacements of the piston 8, for intake and compression there are also obtained the opening and closing of the barrel 2, although at different times and with different lengths of displacement.

For this purpose it is proposed that the journal 22 for connecting the rod or pin 21 to the piston 8 should be lengthened by a portion 22' extending towards the barrel 2 through a longitudinal guide slot 23 formed in the body 6 until becoming located in an oblong slot 24 formed in the lower part of the barrel and engaging from time to time against one end 24' or the other end 24'' of the slot itself during the opening and closing of the barrel respectively.

The length of the oblong slot 24 will always be less than the effective movement of the piston 8 driven by the journal 22 and measured as a function of the amount of forward displacement of the barrel 2 necessary for the insertion of the bullet or pellet 3 through the opening 4 in the frame 1.

Figure 4:
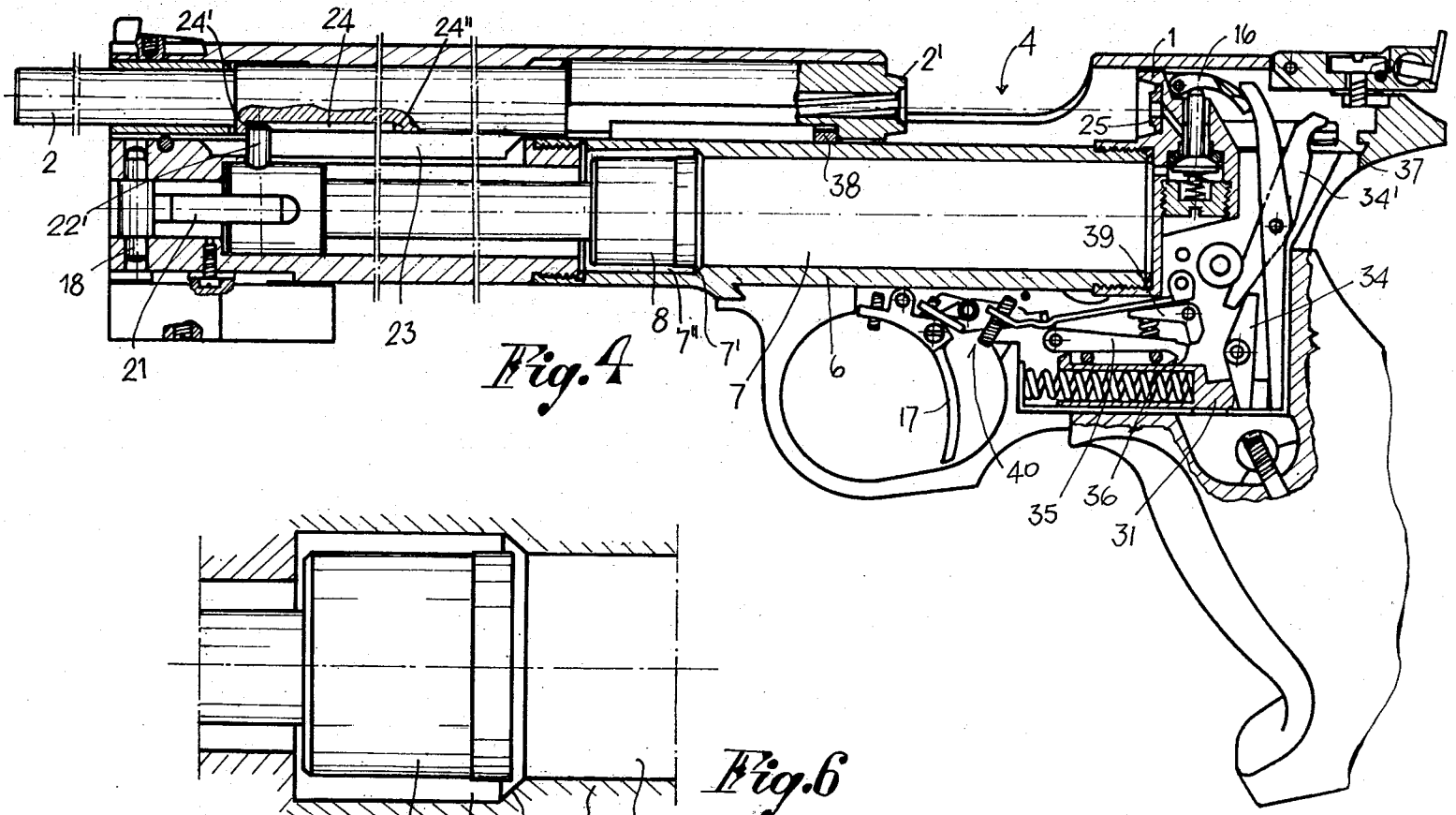
FIG. 4 shows a longitudinal section according to FIG. 3, but with the weapon in the open position.
Figure 6:
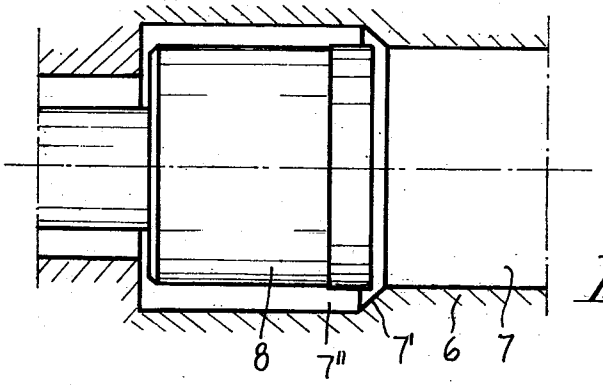
FIG. 6 shows a magnified detail of the cylinder and piston unit for the intake and compression of air.

According to a further feature of the present invention, it is proposed that, within the cylindrical chamber 7, at a space from its base with hole 9 slightly greater than the length of the intake movement of the piston 8, there should be formed an enlargement defined by a step or bevel 7' (see FIG. 4 and in particular FIG. 6). At the end of its intake movement, said piston 8 becomes displaced beyond the said step or bevel 7' in order to permit free access of air into the chamber 7 from the back of the piston itself and through the space 7'' between its peripheral surface and the enlarged portion of said chamber. In practice, such an arrangement makes it possible to obtain firstly, during the greater part of the movement of the piston and due to the contact of the piston with the surface of the chamber 7, correct intake of air through the hole 9, and the compression chamber 10 and then a reliable and complete filling of the chamber 7, whilst the piston 8, at the end of its movement, is displaced beyond the step or bevel (see FIGS. 4 and 6). It follows that, with the return movement of the piston, when said piston is displaced on the step or bevel 7' towards the interior of the chamber 7, all the air will be enclosed in said chamber and finally compressed in the chamber 10. This makes it possible to achieve a higher pressure of the air available in the chamber 10 and advantageously to eliminate the radial intake holes provided in weapons of known type corresponding to the cylindrical chamber and hence also the intense wear that said holes suffer for the fittings of the piston.

According to a further feature of the present invention it is proposed that the shanks of the journals 18, 20 connecting the operating lever 19 to the body 6 and to the rod or pin 21 and of the journal 22 connecting said rod to the piston 8, respectively, should not be in alignment with each other when the said operating lever is in contact with the body 6 after the closure of the barrel and the compression of the propelling air in the chamber 10. In fact, the intermediate journal 20 must not be on the same line passing through the axes of the journals 18, 22 although, under the above-mentioned conditions, it should be displaced beyond such line relative to the direction of contact of the lever of the body 6, as shown in FIG. 5 of the drawings.

Figure 5:
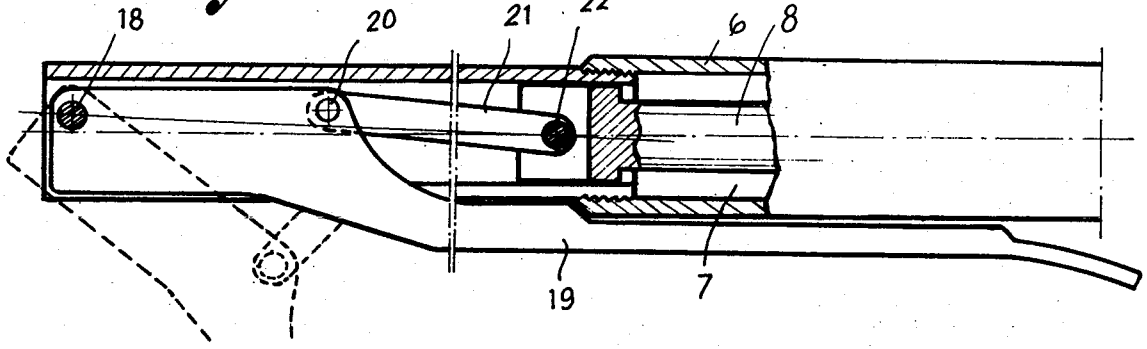
FIG. 5 shows a section taken on the line V—V of FIG. 3 which illustrates the staffs linking the operating levers.

Such an arrangement provides the maximum compression thrust on the piston when the journal 20 passes through the condition of alignment with the journals 18, 22, after which, when such a condition is surmounted to reach that of FIG. 5 it becomes disposed beyond a dead centre which ensures the perfect closing of the barrel 2, which closure cannot be accidentally altered, but only by manual intervention, hence voluntary, on the operating lever 19.

Figure 7:
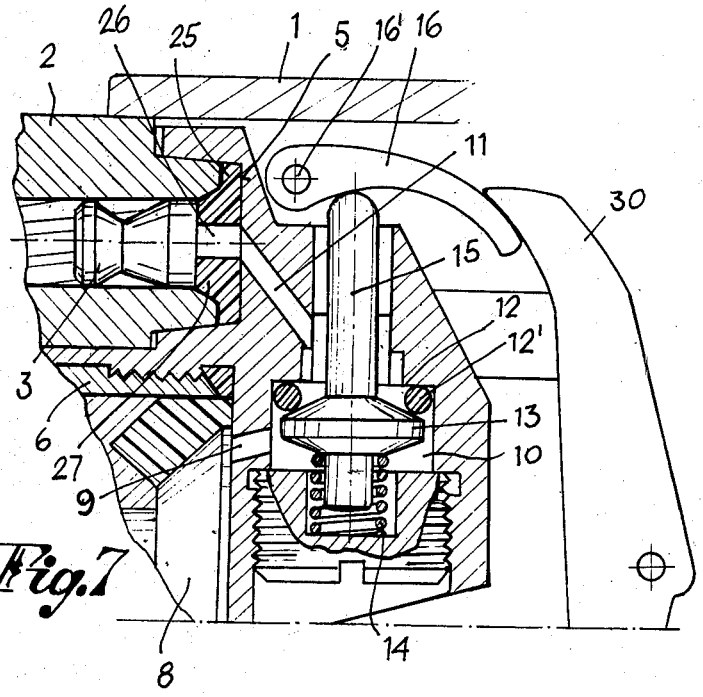
FIG. 7 shows a magnified detail of the unit with closing member of the breach of the barrel.

In the weapon which has now been described it is also proposed that a seal 25 should be provided between the breach 2' of the barrel 2 and the closure shoulder 5 there should be mounted a seal 25 to ensure the perfect closure of the barrel, thereby avoiding any dispersion of compressed air when said air flows from the compression chamber to the bore of the barrel through the passage 11. Said seal 25 is in the form of a tablet of suitable plastics-elastic material and is fixed against the shoulder 5. It has (see FIG. 7) a central bore 26 coinciding on one side with the discharge passage 11 of the air and extending substantially co-axially with the bore of the barrel. This seal 25 also has a tapered front projection 27 intended to be inserted in the bore of the barrel 2 when said barrel is in the closed position. Said front projection 27 preferably acts as means for the forced insertion of the bullet or pellet 3 into the barrel, thus subjecting the bullet itself, already at the moment of closure, to a prealignment corresponding to that of the barrel.

Figure 3:
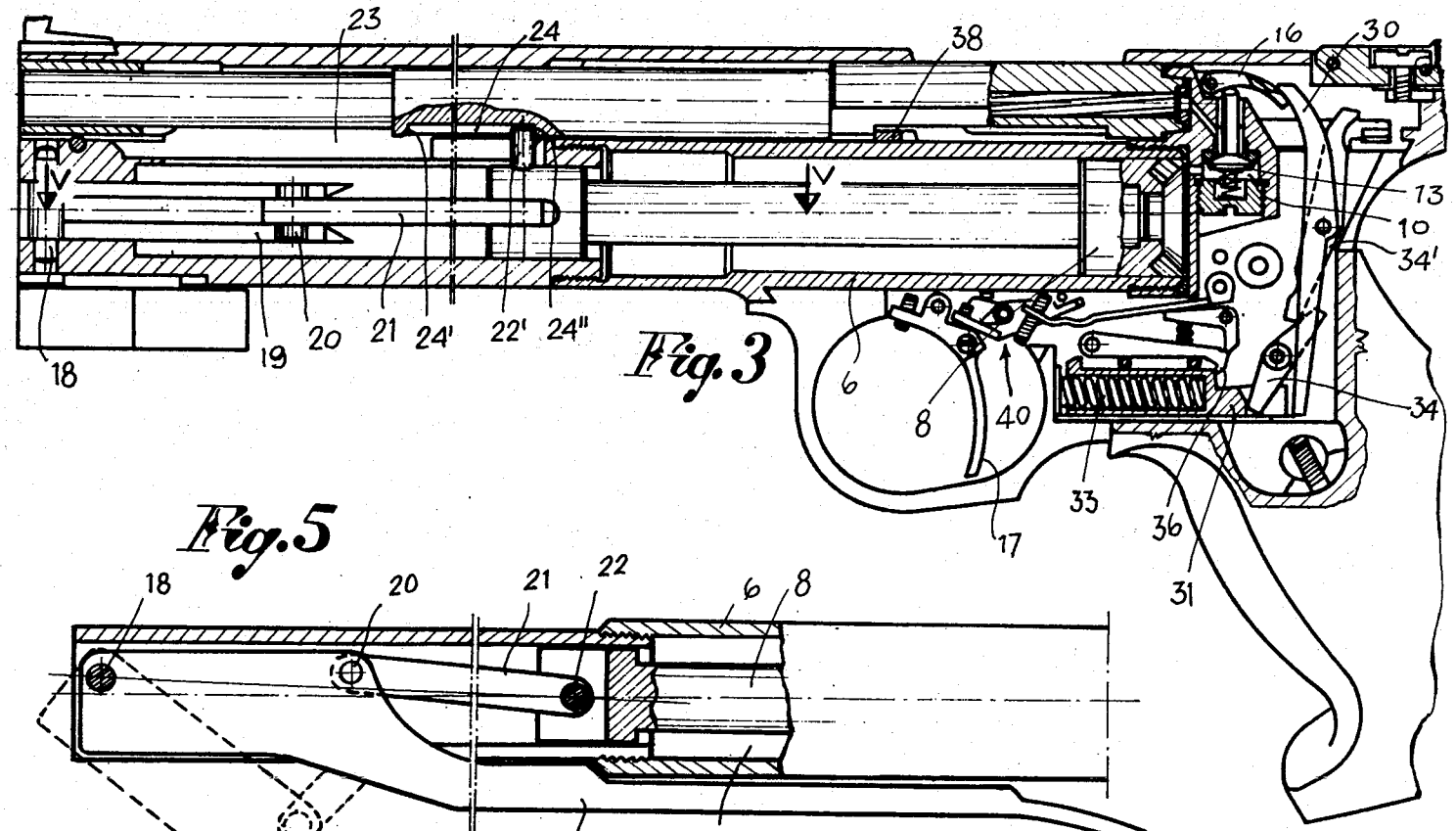
FIG. 3 shows a longitudinal section of the weapon in the closed position taken on the line III—III of FIG. 1.
Figure 8:
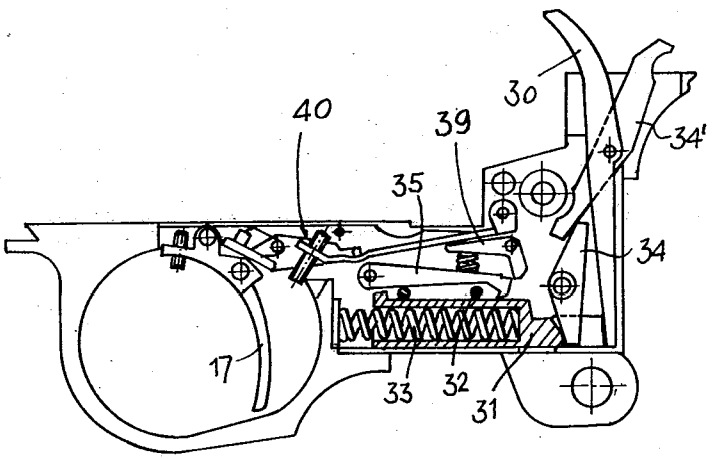
FIG. 8 shows the assembly or control mechanism separated from the weapon.

As regards the assembly or release mechanism intended to control the thrust lever 16 acting on the stem of the valve 13, it compresses in accordance with the preferred embodiment shown in FIGS. 3, 4 and 8, a first rocker lever 30 associated with part of said lever 16 and engaged on the opposite side by a small hammer 31 axially displaceable on guide members 32 and biased by a spring 33 for forcing it towards said lever 30. Associated with the hammer 31 are an arming lever 34 for displacing it backwardly or away from the lever 30 and in opposition to the spring 33, also a stop lever 35 having a tooth 36 intended to engage and retain the hammer 36 in its retracted or armed position (see FIG. 3). In turn the arming lever 34 is controlled by a rocker lever 34' engaged by a tooth 37 connected to an inclined slide 38 attached to and displaceable with the barrel 2 of the weapon so that the opening of the barrel corresponds by way of the levers 34', 34, with the arming of the hammer 31, whilst with the closure of the barrel, said slide is displaced into a condition of rest ready for subsequent arming.

Associated with the stop lever 35 is a spring mounted lever 39 for keeping the said stop lever engaged with the hammer 31 so that it does not act on the trigger 17, there being between said lever and said trigger a release lever formed by spring members indicated as a whole by 40 in FIGS. 3 and 8 of the drawings. Preferably, and contrary to what is done in known pre-compressed air weapons, the mechanism or assembly formed by the trigger 17, the hammer 31 and the levers 30, 34, 35–39 and 40, is mounted on a single support to form a unit which may be mounted and removed as a unit from the weapon (see FIG. 8) so as to be prepared and subjected to maintenance as required, separately from the remaining parts of the weapon.

In practice, during use of the weapon after each firing of the bullet or pellet in the barrel, in order to obtain the reloading of the weapon it is only necessary to move the operating lever 19 in the direction of the arrow F in FIG. 2, to insert the bullet or pellet 3 into the barrel 2 and then to return the lever 19 to the body 6 as shown in FIG. 1.

As stated above, with the forward angular displacement of the lever 19 in the direction of the arrow F, air is taken into the cylindrical chamber 7 by means of the piston 8 displaceable with said lever and, in a second phase, the forward displacement of the barrel 2 for the opening thereof by means of the part 22' of the journal 22.

In fact, in the first part of the intake displacement of the piston 8, the barrel 2 still remains closed, since the portion 22' which, with the barrel closed, acts against the end 24'' of the slot 24 and begins to move in the oblong slot 24 without having any influence on the barrel. In this phase, the components of the release mechanism or assembly keep the valve 13 open, whereby the air can be drawn into the cylindrical chamber 7 from outside through the barrel 2, the discharge bore 11, the chamber 10 and the base bore 9.

With the continuance of the displacement of the lever 19 according to the arrow F, the portion 22' of the journal 22 bears against the end 24' of the oblong slot 24 then actuating the forward displacement of the barrel for the opening thereof together with the displacement of the piston and thus to complete the intake phase of the air into the chamber 7.

With the opening of the barrel 2 there is also obtained the displacement of the mounting slide 38 which, by means of the arming levers 34, 34', displaces the spring-mounted hammer 31, 33 in the locked or arming position (see FIG. 3), said hammer being retained in this position by means of the locking lever 35 cooperating with the spring mounted lever 39.

Under these conditions the valve 13 is released from the action of the thrust lever 16 on the associated stem 15 whereby biased by the spring 14, it is displaced into the closed position of the seat 12 and hence of the compression chamber on the part of the discharge passage 11.

In the final phase of the intake movement, the piston 8, as stated above, moves beyond the step or bevel 7' permitting complete filling of the chamber 7.

After the insertion of a bullet or pellet 3 into the barrel 2, the operating lever 19 is displaced until it is in contact with the body 6. Such a displacement of the operating lever firstly results in a partial displacement of compression of the piston 8 in the cylindrical chamber 7, whilst the barrel remains stationary until the portion 22' of the journal 22 bears against the end 24'' continuing with the displacement of the lever 19, thus obtaining the displacement of the piston 8 for the last compression phase of the air in the chamber 10 through the bore 9 simultaneously with the displacement backwardly of the barrel 2 until the closing and locking of its breach 2' against the seal 25. Under these conditions the weapon is ready for use: in fact it is only necessary to operate the trigger 17 to obtain the flow of compressed air in the chamber 10 towards the bore in the barrel in order to fire the bullet or pellet 3.

Both when the weapon is a pistol and when it is a rifle, the two types of weapons are both constructed in accordance with the above described features by changing, when desired, only the arrangement of the release mechanism or assembly.

Figure 9:
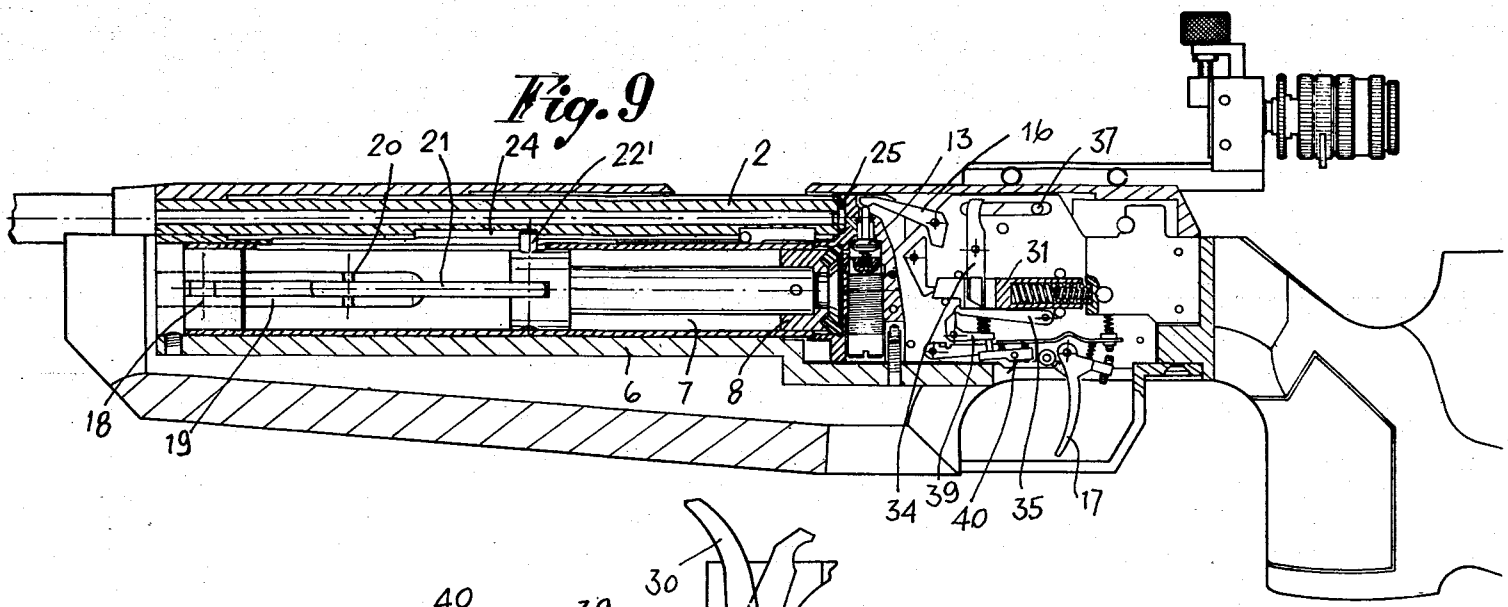
FIG. 9 shows a cross-section of the weapon in the form of a rifle.

FIG. 9 of the drawings in fact shows in section the assembly of a rifle with the associated release mechanism and in this figure the same reference numerals are used as in FIGS. 1 and 8 to indicate similar parts.

I claim:

1. A weapon using pre-compressed air and comprising a frame, a barrel mounted on said frame and having a breach closable against a stationary shoulder and a cylindrical chamber with a displaceable piston therein for the intake of air into said cylindrical chamber, a compression chamber into which said piston compresses air, said compression chamber being closable and openable by means of a mushroom-shaped valve, said compression chamber communicating with the bore of said barrel through a discharge bore opening into said stationary shoulder, the opening and closing of said valve being controlled by a spring and a release mechanism actuated by a trigger, said mechanism being activated by means of a mounting slide connected to said barrel, in which said barrel is guided on said frame to displace itself axially from a closing position against said stationary shoulder to an opening position and vice versa, said cylindrical chamber with its axis parallel to said barrel and formed in a body secured to said frame, and said barrel and said piston are jointly displaceable over at least a part of the intake and compression movements of said piston, to the final part of the intake movement of said piston, a forward displacement of said barrel being for its opening and for the activation of said release mechanism by means of said mounting slide, the final part of the compression movement of said piston corresponding to the displacement for closing and locking said barrel against said shoulder, said piston having a radial portion extending through a guide slot formed in said body towards the barrel to become disposed in an oblong recess formed on said barrel, said recess having two ends against which said radial portion is alternately in contact to determine the opening and closing displacement of said barrel during the displacement of said piston, the length of said oblong slot being less than the effective intake and compression movements of said piston.

2. A weapon as claimed in claim 1 wherein a pin is pivoted on said piston and also pivoted on an operating lever which in turn, is pivoted on said body, said operating lever being laterally displaceable both forwardly from a position in contact with said body to a position almost in alignment therewith, and vice versa, in order to actuate the intake and compression displacements of said piston.

3. A weapon as claimed in claim 2, wherein said radial portion is formed by an extension of the journal connecting the piston to the pin connected to the operating lever.

4. A weapon as claimed in claim 3, wherein the pivotal axis between the operating lever and the pin is displaced relatively to the alignment between the two pins for the pivoting of said lever on the said body and of the pin on the piston when the operating lever is adjacent to the body, said axis being displaced to become adjacent to said lever on said body, beyond the line passing through the said pins.

5. A weapon as claimed in claim 1, wherein the cylindrical chamber for receiving the piston has an enlargement defined by a step formed with a clearance from the bottom of the chamber slightly greater than the intake movement of the piston, said piston being displaced beyond said step at the end of its return movement to permit free access of air into said chamber from the back of the piston.

6. A weapon as claimed in claim 5, wherein said piston, at the end of its intake movement, defines with the enlarged zone of the cylindrical chamber, a gap for the flow of air towards said chamber.

7. A weapon as claimed in claim 1, wherein a seal is secured to the stationary shoulder for the closure of the breach of the barrel, said seal being formed by a tablet-shaped member having a centre aperture coinciding with the outlets for the compressed air towards the barrel and with the bore of the barrel, said bore of the seal being coaxial with the bore of the barrel.

8. A weapon as claimed in claim 7, wherein said seal has a tapered front projection for insertion into the bore of the barrel for holding a bullet or pellet to be fired.

9. A weapon as claimed in claim 1, wherein the spring and release mechanism represents an independent unit which may be applied to or separated from the weapon as a whole.

10. A weapon as claimed in claim 1, wherein said spring and release mechanism comprises a trigger, a release lever associated with said trigger, a small hammer axially displaceable towards and away from a rocker lever, said hammer being biased by a spring tending to keep it displaced towards said rocker lever, an arming lever controlled by the mounting slide displaceable with the barrel, said arming lever co-operating with a second arming lever in order to displace said hammer away from the rocker lever in opposition to said spring, and a stop lever with a tooth for engaging said hammer in the position in which it is removed from said rocker lever, a spring lever being associated with said stop lever acting as a connection between the discharge lever and said rocker lever to release the hammer when the trigger is operated.

11. A weapon in the form of a compressed air gun with a frame, a barrel mounted therein and movable in the longitudinal direction, the rear extremity of said barrel being closable against a closure shoulder, a piston which is mounted in and displaceable within a cylindrical chamber for the aspiration and compression of the air, and a container with a closing valve, said container communicating with the barrel by means of a channel which is coaxial with respect to the barrel and a control mechanism for controlling the opening and closing of said valve, the longitudinal displacement of the barrel being coupled with that of the piston, a control lever means being provided for the displacement of the piston which control lever means is articulated on a body which comprises said cylindrical chamber and which lever is connected to the piston by means of a movable element, characterized in that on the piston there is provided a portion which protrudes in the generally radial direction and which protrudes toward the barrel through a slit provided in the body united to the cylindrical chamber and which is inserted in an oblong notch provided on the barrel; the surfaces which define said notch forming the engagement means for said radial portion; the length of said notch being less than the length of the run of the piston during the phase of aspiration and/or compression; a slide means being connected to said barrel so as to activate the control mechanism when the barrel is displaced in the axial direction.

12. The weapon according to claim 11, characterized in that said radial portion comprises an extension of a pin which connects the piston with the guiding element which in turn is connected to the control lever.

13. The weapon according to claim 11 characterized in that the cylindrical chamber has an enlargement defined by a step which permits the entry of the air into said cylindrical chamber, said enlargement being spaced from the bottom of said chamber, said spacing being smaller than the aspiration run or displacement of the piston.

14. The weapon according to claim 11, characterized in that the barrel can be pushed against a gasket provided on the closure shoulder by means of the radial portion; said gasket having a frusto-conical shape having a central opening which forms the channel provided for the entry of the compressed air into the barrel and having a diameter equal to that of the opening in the barrel, said opening being coaxial with respect to said gasket.

15. The weapon according to claim 14, characterized in that said gasket has a protrusion centrally located, conically shaped and penetrating into the barrel during the closing thereof.

16. The weapon according to claim 15, characterized in that the control mechanism is provided on a suitable support which can be mounted and dismounted on the weapon together with said control mechanism.

17. The weapon according to claim 16, characterized in that the control mechanism comprises a trigger, and a hammer displaceable in two directions which actuates the valve; a first lever, said hammer being pushed in the direction of the first lever by a spring and being moved away from said first lever by means of a second lever, in opposition to the force exerted by the spring; said second lever interacting with a third lever which is actuated by means of said slide means which is displaceable by means of the barrel; there being provided furthermore an arresting element having a tooth for withholding the hammer in its rear position with respect to the first lever; said element cooperating with an angular lever which during the operation of the trigger frees said hammer from said arresting element by means of a spring mechanism.

* * * * *